US005267691A

United States Patent [19]

Zeman

[11] Patent Number: 5,267,691

[45] Date of Patent: Dec. 7, 1993

[54] SPRAY STRUCTURES WITH INTEGRAL STAKES

[76] Inventor: David Zeman, c/o Disco, P.O. Box 42040, Las Vegas, Nev. 89116

[21] Appl. No.: 918,766

[22] Filed: Jul. 27, 1992

[51] Int. Cl.[5] ..... B05B 1/04; B05B 15/06

[52] U.S. Cl. ..... 239/276; 239/518; 239/521

[58] Field of Search ..... 239/273, 275, 276, 518, 239/521, 520, 522

[56] References Cited

U.S. PATENT DOCUMENTS

| | | | |
|---|---|---|---|
| D. 231,628 | 5/1974 | Bartels | D8/1 |
| D. 263,903 | 4/1982 | Johnston | D6/112 |
| D. 284,785 | 7/1986 | Lemkin et al. | D23/7 |
| D. 285,409 | 9/1986 | Lemkin et al. | D8/356 |
| D. 316,367 | 4/1991 | Olson | D8/356 |
| 949,520 | 2/1910 | Choate | 239/521 |
| 1,108,058 | 8/1914 | Yerkes | 239/275 |
| 1,763,119 | 6/1930 | Archer | 239/275 |
| 2,329,231 | 9/1943 | Thomas | 239/275 |
| 2,480,989 | 9/1949 | Weaver | 239/276 |
| 3,193,205 | 7/1965 | Hanson | 239/276 |
| 3,595,524 | 7/1971 | Mominee | 251/342 |
| 3,638,863 | 2/1972 | Roberts | 239/276 |
| 4,067,498 | 1/1978 | Holcomb | 239/521 |
| 4,852,806 | 8/1989 | Zeman | 239/276 |
| 5,183,206 | 2/1993 | Garin | 239/521 |

FOREIGN PATENT DOCUMENTS

| | | | |
|---|---|---|---|
| 2038974 | 6/1979 | United Kingdom | 248/87 |

*Primary Examiner*—Andres Kashnikow
*Assistant Examiner*—Christopher G. Trainor

[57] ABSTRACT

A spray structure with an integral stake useful in spraying water in gardens and related locations can be constructed inexpensively by forming on the top of a stake a spray mechanism including a horizontally extending nipple having an elongated groove leading to a surface which is employed to divert water passing through the groove in the nipple toward a deflecting surfaced which deflects such water outwardly form the stake. The stake preferably includes a flat strip transverse to the orientation of the nipple which aids in preventing tilting of the entire structure when a watering tube is mounted on the nipple.

4 Claims, 4 Drawing Sheets

SPRAY STRUCTURES WITH INTEGRAL STAKES

BACKGROUND OF THE INVENTION

The invention set forth in the specification pertains to new and improved spray structures having integral stakes.

For a number of years it has been known to form spray structures having stakes holding or supporting grooved nipples and deflection surfaces located generally opposite or adjacent to the ends of the grooves in such nipples. When the end of a water distribution tube is slipped upon such a nipple and water is supplied to the tubing water will pass through the groove in the nipple so as to be directed toward the deflection surface associated with it. Such spray structures ca be and are satisfactorily used in many different applications. Thus, they have been and are used in various different types of gardens and horticultural applications.

Surprisingly in some of such applications the spray structures of the invention can be considered as somewhat undesirable because of the manners in which the nipples in them are oriented. Most commonly such nipples are located so that as a stake is inserted in the ground the nipple is pointed in a vertical, upward direction but it is also known to have such nipples located so that they extend vertically downward as a stake is inserted in the ground.

Such upwardly extending nipples are considered disadvantageous because the water distribution tubes connected to them for a partial loop adjacent to the nipples as they traverse the distance between them and the ground or other common supports. This can be considered unsightly in some applications. It is also disadvantageous in that it creates an "unbalanced" situation which may tend to apply a force to a stake to cause it to tilt over, particularly in damp, somewhat plastic soil. If a tube is not tightly fitted on a nipple such a force may also tend to pull the tube off of the nipple.

The difficulty encountered with downwardly extending nipples is of a different nature. Gravity will tend to move a water distribution tube off of a downwardly extending nipple, particularly if the nipple and tube do not fit tightly together. At times even when such a tube and nipple fit tightly as they are installed they will subsequently fit loosely with respect to one another as a result of the tubing becoming somewhat soft and pliable as a consequence of being warmed by ambient air and the absorption of the sun's radiation.

BRIEF SUMMARY OF THE INVENTION

It is considered that it will be apparent from the preceding discussion that there is a need for new and improved spray structures which incorporate stakes. A broad objective is to provide spray structures which fulfill or meet this need. More specific objectives of the invention are to provide spray structures with integral stakes which are advantageous because as they are used attached watering tubes do not project upwardly from such structures and do not tend to exert significant forces which would tend to cause them to bend or tilt as they are supported by the ambient ground.

Because such tubes do not project generally upwardly from the new structures of the invention are believed to be more aesthetically desirable than prior related structures. Another objective of the invention is to provide spray structures as indicated which are constructed so that gravity does not tend to cause water tubes to slide off of the nipples on such structures. Further objectives of the invention are to provide spray structures as described which may be easily and conveniently manufactured and which may be satisfactorily used over prolonged periods.

These and various other related objectives of the invention are achieved by providing a spray structure having an elongated stake, said stake having an upper and a lower end, a nipple for engaging the interior of an end of a water distribution tube, said nipple being supported by said stake remote from said lower end of said stake, said nipple having at least one groove located on its external surface, said groove extending between the ends of said nipple so that when said tube is located on said nipple, water can be conveyed from said tube through said groove to the end of said nipple remote from said tube, and a deflection surface for distributing water passing through said groove from said tube, said deflection surface being supported by said stake remote from said lower end of said stake and being located so as to be inspected by water passing through said groove and so that such water passing through said groove is disseminated away from said stake.

In the spray structure the nipple is located so as to extend transversely to said upper end of said stake so that when said stake is used with said lower end of said stake extending into soil so as to extend vertically upward from said soil said nipple extends horizontally, the orientation of said nipple when said stake is so used permitting said tube to extend generally along the surface of said soil so as to be supported by said surface of said soil and so as to be elevated off of said surface of said soil only to the limited extent necessary for said end of said tube to be engaged on said nipple.

The invention includes many other aspects and features than are indicated by the preceding comparatively brief statement. These will be apparent from a consideration of the remainder of this specification and the accompanying drawing.

BRIEF DESCRIPTION OF THE DRAWING

Because of the nature of the present invention it is best more fully explained with reference to this drawing in which.

Figure 1:
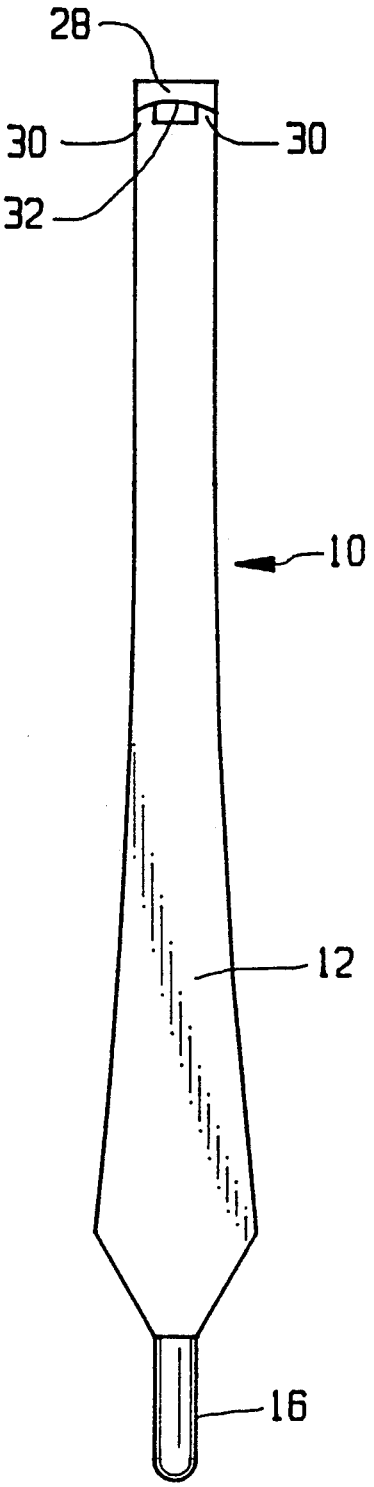
FIG. 1 is a front elevational view of a presently preferred spray structure with an integral stake in accordance with this invention.
Figure 2:
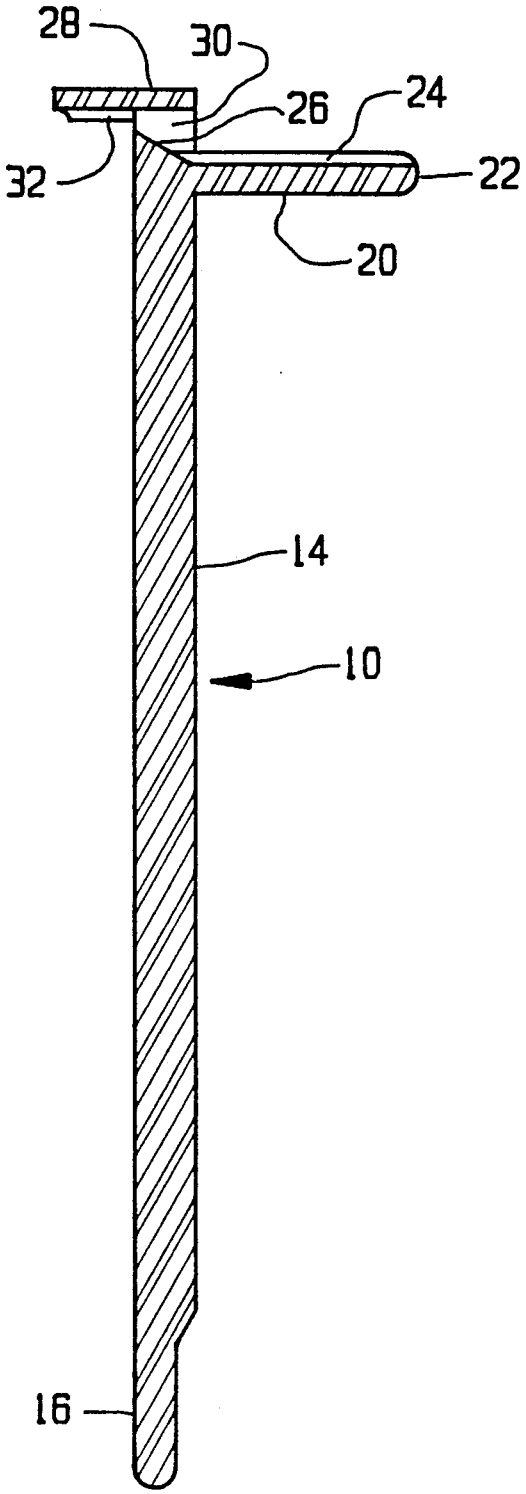
FIG. 2 is a cross-sectional view of the stake shown in FIG. 1.
Figure 3:
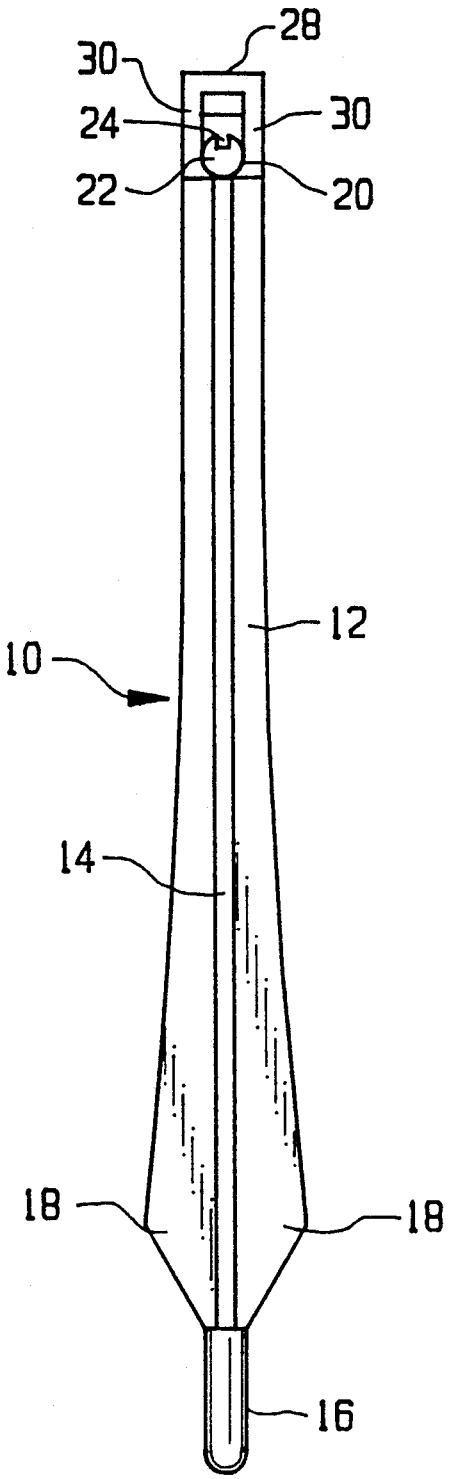
FIG. 3 is a rear elevational view of the stake shown in the preceding figures.
Figure 4:
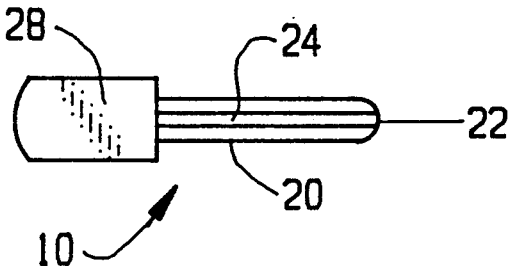
FIG. 4 is a top plan view of this stake.

In the subsequent detailed description and in the drawings the same numbers are used in or in connection with the embodiments shown in various different figures to designate items which are the same or substantially the same in such figures in order to avoid having to separately describe such items in connection with each embodiment of the invention. Both in the drawings and in the subsequent discussion matters which are essentially matters of routine skill in the field of the invention have not been illustrated or described.

No effort has been made in the drawing and in the remainder of this specification to illustrate or describe all theoretically possible permutations and combinations and modification of the features of the invention which are within the skill of an ordinary worker in the field of the design of tubing used for plant watering or irrigation purposes. For this reason the invention is to be considered as being limited solely by the accompanying claims forming a part of this specification and is not to be considered as being limited to items which appear precisely as illustrated in the drawings.

DETAILED DESCRIPTION OF THE PREFERRED EMBODIMENTS

In the initial four figures of the drawings there is shown a stake 10 in accordance with the invention which may be easily and conveniently constructed as a one piece structure at a comparatively nominal cost by injection molding techniques using comparatively simple dies from a known polymer composition such as is currently used in producing related, rigid spray structures (not shown). This stake 10 includes an elongated, vertically extending flat strip 12 carrying a vertically extending reinforcing rib 14.

Both the strip 12 and the rib 14 terminate in a somewhat pointed end 16 which is designed to facilitate insertion of the stake 10 into the ground. When it is so inserted the strip 12 is oriented so as to resist any tilting of the stake 10 as this stake 10 is used. If desired tapered shoulders 18 can be provided on the strip adjacent to the end 16 so as to facilitate insertion of the stake into the ground.

The strip 12 carries a rearwardly extending cylindrical nipple 20 terminating in a rounded end 22. While this nipple 20 preferably extends at a 90° angle to the strip 12 if desired it can extend upwardly a slight amount such as about 5° from this 90° angle so as to impede the removal of a watering tube (not shown) from the nipple 20 if the stake 10 is tiped slightly and is not precisely vertical. The nipple 20 is supported by the rib 14 as shown so as to minimize the changes of it being broken off of the strip 12.

Figure 5:
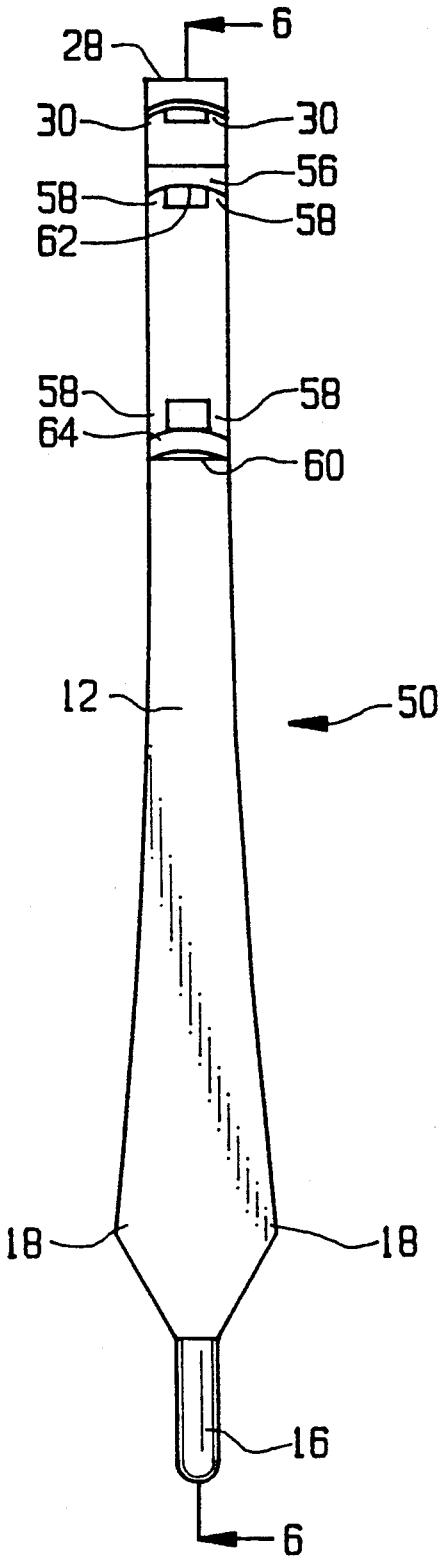
FIG. 5 is a front elevational view of a modified spray structure with an integral stake in accordance with this invention.
Figure 6:
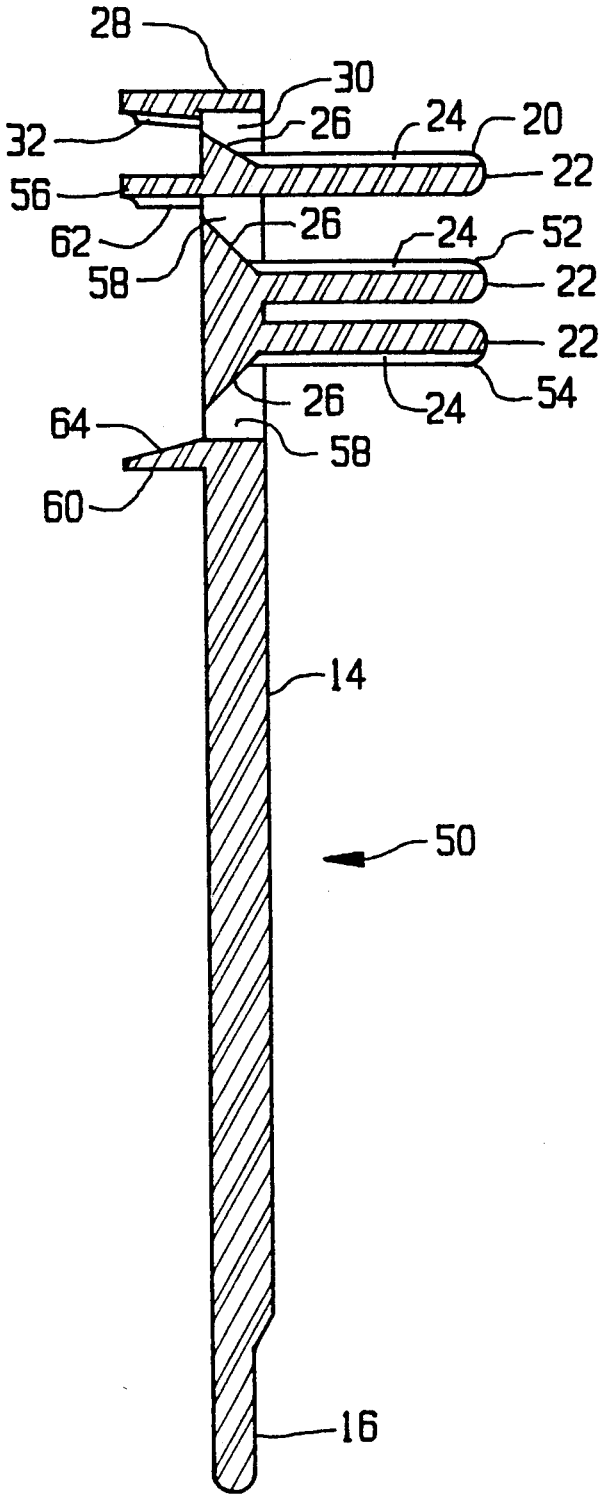
FIG. 6 is a cross-sectional view taken at line 6—6 of FIG. 5.
Figure 7:
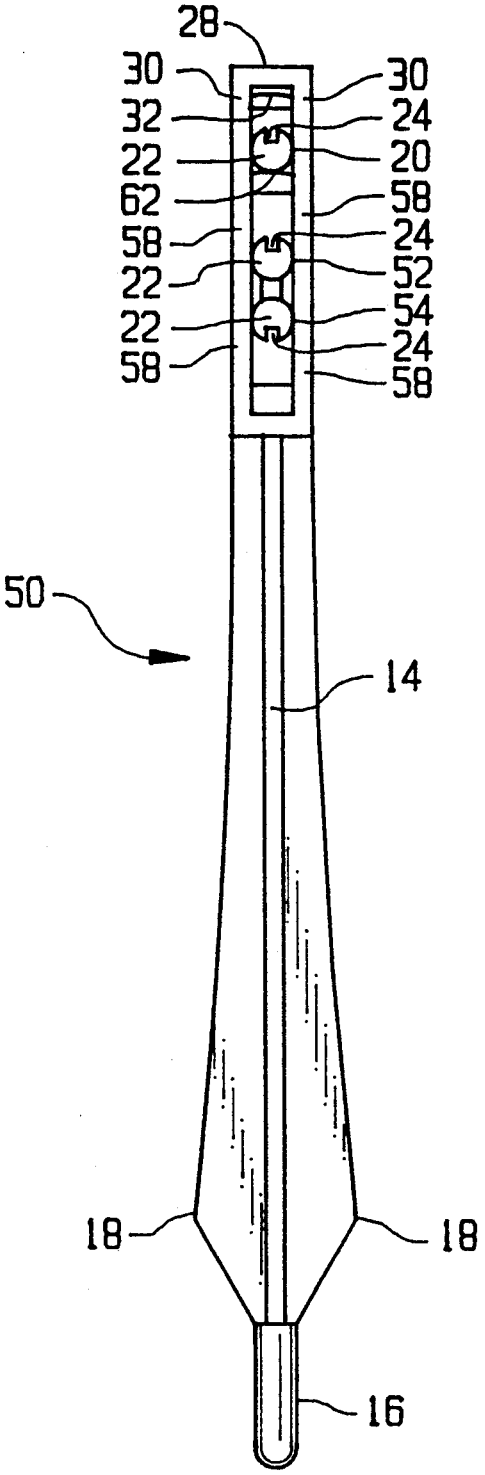
FIG. 7 is a rear elevational view of the stake shown in the preceding FIGS. 5 and 6.
Figure 8:
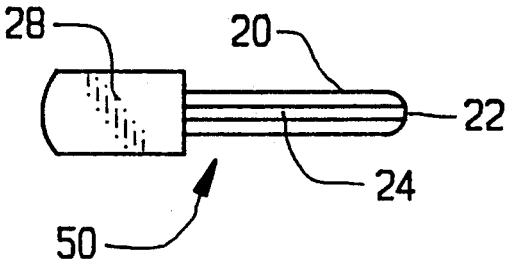
FIG. 8 is a top plan view of this stake.

Nipple 20 is also provided with a horizontally extending groove 24 leading from the end 22 to a short upwardly sloping surface 26 located so as to extend upwardly at an acute angle from the horizontal generally toward a deflecting hood 28. This attaching hood 28 includes short legs 30 supporting it on the strip 12 so that a curved, downwardly facing deflecting surface 32 is located so that it will receive water directed toward it by the surface 26. The configuration of the surface 32 can be varied in accordance with routine experimentation so as to achieve various different spray effects. used to provide a single type of water spray as determined by the configuration of the surface 32. In a sense this is a limitation since on occasion it will be apparent after a stake 10 is installed that a different type of spray than is achieved with the stake 10 is needed or desirable. The complication can be avoided by using the modified stake 50 shown in FIGS. 5–8 of the drawing. It differs from the stake 10 by including beneath the previously described nipple 20 two other nipples 52 and 54.

These nipples 52 and 54 are located parallel to one another so as to extend to the rear of the strip 12 at an angle as employed with the nipple 20 and are reinforced against bending by unnumbered portions of the rib 14. Each of them includes a groove 24 and a short sloping surface 26 as previously discussed. The surface 26 on the uppermost nipple 52 is directed upwardly toward a further deflecting hood 56 located on extensions 58 of the legs 30 while the surface 26 on the lowermost nipple 54 is directed downwardly between these extensions 58 toward a horizontally extending wall 60 serving as a deflecting member (not separately numbered). The hood 56 and the wall 60 are provided with further deflecting surfaces 62 and 64, respectively.

All three of the deflecting surfaces 32, 62 and 64 are preferably shaped differently as shown so as to provide the user of the stake 50 with an option as to what type of spray pattern he or she may wish to use. It will be obvious that this option may be exercised by connecting a water distribution tube (not shown) on the nipple 20 associated with the surface 32, 63 and 64 which will give a desired spray pattern.

When either the structure 10 or the structure 50 is used with such a tube (not shown) connected to a nipple 20 the tube will not project directly up from the structure 10 or 50 and, hence, is less viable than if it did so project and, also, will not exert as much force on the structure 10 or 50 tending to cause it to twist in the ground so that it will no longer be directed as originally intended. Also, with these structures 10 and 50 there will be little tendency for the weight of such a tube tending to cause it to slip off of a nipple as would be the case if the nipple extended downwardly from an appropriate support.

I claim:

1. A spray structure comprising:

an elongated stake, said stake having an upper and a lower end;

at least one nipple on said stake for engaging the interior of an end of a water distribution tube, said nipple being attached to said stake remote from said lower end of said stake, said nipple extending generally transversely to the length of said elongated stake generally at the upper end thereof, said nipple having at least on groove located on its external surface, said groove extending between the ends of said nipple so that when said water distribution tube is located on said nipple water can be conveyed from the tube through said groove to the end of said nipple remote from the tube;

walls defining an opening through said stake in line with said groove, one of said walls being a reflecting face in said opening in line with said groove, a hood beyond said opening, a deflection surface on said hood for deflecting water passing through said groove from said tube and reflected from said reflecting face, said deflection hood being mounted on said stake remote from said lower end of said stake and being located so as to be engaged by water passing through said groove and reflected from said reflecting face so that such water passing through said groove is disseminated away from said stake.

2. A spray structure as claimed in claim 1 wherein:

said deflection surface and said nipple are located relative to said stake structure so that when said spray is used said nipple will be aligned with the direction of the water deflected by said deflection surface so as to provide a visual indication of such direction as said stake is inserted into soil.

3. A spray structure as claimed in claim 1 wherein:

said lower end of said stake being shaped so as to include an enlarged flat surface extending transverse to the direction in which said nipple extends from said stake so as to provide resistance against movement in soil such as might be caused by the weight of said nipple and said end of said tube being located at one side of said stake.

4. A spray structure as claimed in claim 1 wherein:

said spray structure includes a plurality of said nipples and a plurality of said deflection surfaces, the number of said deflection surfaces being the same as the number of said nipples, each of said deflection surfaces corresponding to and being located adjacent to one of said nipples, said spray structure being capable of being used with said water distribution tube being engaged with one of said nipples and, when desired in order to distribute a greater amount of water than can be distributed using a single one of said nipples and its corresponding deflection surface, said spray means being capable of being used with separate water distribution tubes attached to more than one of said nipples.

* * * * *